United States Patent [19]

Tamagawa et al.

[11] Patent Number: 4,803,191

[45] Date of Patent: Feb. 7, 1989

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 157,668

[22] Filed: Feb. 19, 1988

[30] Foreign Application Priority Data

Feb. 19, 1987 [JP] Japan ..... 62-36249

[51] Int. Cl.[4] ..... B41M 5/18

[52] U.S. Cl. ..... 503/200; 428/211; 428/537.5; 428/913

[58] Field of Search ..... 427/150–152; 428/195, 211, 537.5, 913, 914; 503/200, 226

[56] References Cited

FOREIGN PATENT DOCUMENTS 0136492 8/1983 Japan ..... 503/200

0187892 10/1984 Japan ..... 503/200

*Primary Examiner*—Bruce H. Hess

*Attorney, Agent, or Firm*—Sughrue, Mion, Zinn, Macpeak, and Seas

[57] ABSTRACT

A novel heat-sensitive recording paper is provided which comprises a paper support having thereon a heat-sensitive color forming layer, wherein the paper support is made of a base paper which is 7% or less in the sum of fluctuations in uneven formation in a wavelength range of 12.5 to 80 mm as determined by means of a laser formation measuring apparatus.

16 Claims, No Drawings

HEAT-SENSITIVE RECORDING PAPER

FIELD OF THE INVENTION

The present invention relates to a heat-sensitive recording material for use in recording with a thermal head, thermal pen, or the like. More particularly, the present invention relates to a heat-sensitive recording paper excellent in dot reproducibility in half tone recording.

BACKGROUND OF THE INVENTION

Recent years have seen a remarkable development of facsimile equipment and printers. In particular, these apparatus generally employ a heat-sensitive recording system using a combination of a thermal head and a heat-sensitive recording paper comprising a colorless dye such as Crystal Violet Lactone and a phenol compound coated thereon, as described, e.g., in Japanese Patent Publication No. 14039/70.

This heat-sensitive recording system is advantageous in that the recording paper undergoes a primary color formation which requires no development, simplifies the recording apparatus, and reduces the cost of the recording paper and the recording apparatus, and that it use a quiet non-impact process. Thus, this recording system is widely used in various printers and facsimile equipment. Furthermore, the demand for the recording of half tone objects, such as photographs, has grown in recent years. Such half tone recording requires that the heat-sensitive recording paper exhibit an excellent dot reproducibility, particularly in low density regions.

Heretofore, some methods for improving dot reproducibility have been proposed. For example, Japanese Patent Publication No. 20142/77 describes a method which comprises improving the surface of a heat-sensitive color forming layer to a Bekk smoothness of 200 to 1,000 seconds by supercalendering or the like. Japanese Patent Application (OPI) No. 115255/79 (the term "OPI" as used herein means an "unexamined published Japanese patent application") describes a method which comprises smoothing the surface of a heat-sensitive color forming layer to a Bekk smoothness of 1,100 seconds or more. Japanese Patent Application (OPI) No. 156086/78 discloses a method which comprises improving the surface of a heat-sensitive color forming layer to a surface roughness Ra of 1.2 μm or less and a glossiness of 25% or less. Furthermore, Japanese Patent Application (OPI) No. 83841/79 discloses a method which comprises the use of an undercoated paper as a support. These methods provide some improvement in color density in high density regions. However, these methods leave much to be desired with respect to improving dot reproducibility in low density regions.

SUMMARY OF THE INVENTION

It is therefore an object of the invention to provide a heat-sensitive recording paper that causes no sticking to the thermal head and exhibits excellent dot reproducibility in half tone recording.

These objects of the present invention are accomplished with a heat-sensitive recording paper comprising a paper support having thereon a heat-sensitive color forming layer, wherein the paper support is made of a base paper which is 7% or less, and preferably 5% or less, in the sum of fluctuations in uneven formation in a wavelength range of 12.5 to 80 mm as determined by means of a laser formation measuring apparatus.

DETAILED DESCRIPTION OF THE INVENTION

The present invention will be first described with reference to the definition of the fluctuations in uneven formation.

The measurement of formation was accomplished by means of Sheet Formation Tester (manufactured by Toyo Seiki Seisakusho K.K.). The fluctuations in uneven formation was accomplished by a weighing fluctuation process. Specifically, the fluctuations in the laser transmission of a paper is measured as a time series signal which is then statistically processed to obtain uneven formation in the equation defined below. This is accomplished by dividing the RMS (root mean square) value of the signal by the mean transmission to give fluctuation $F_T$ as follows:

$$F_T = \sqrt{\frac{1}{T}\int_O^T (f(t) - \overline{f(t)})^2 dt} \Big/ \overline{f(t)}$$

wherein f(t) represents the light transmission at a certain point on the paper; $\overline{f(t)}$ represents the average light transmission; and T represents the integrating time.

The measurement of formation is described in detail in *Convertech*, (March 1986, pp. 41–43, published by Converting Technology).

Specific examples of the process for the preparation of base paper for heat-sensitive recording paper will be described hereinafter.

As pulp there may be used any of wood pulp such as LBKP(Laubholz Bleached Kraft Pulp), LBSP(Laubholz Bleached Sulfite Pulp), NBKP(Nadelholz Bleached Kraft Pulp), NBSP(Nadelholz Bleached Sulfite Pulp), LDP(Laubholz Dissolving Pulp), and NDP(Nadelholz Dissolving Pulp), or straw pulp, bagasse pulp, or linter pulp. Preferred among these pulps is LBSP and LDP. At least one of LBSP and LDP is preferably contained in the pulp in an amount of 10% by weight or more, and particularly preferably in an amount of from 20 to 60% by weight.

The content of Laubholz pulp obtained by adding LBKP to LBSP and LDP is preferably 90% by weight or more. The freeness of the pulp is generally 200 to 400 cc of C.S.F.(Canadian Standard Freeness), preferably 250 to 350 cc of C.S.F. For the length of pulp fiber which has been beaten, the sum of 24-mesh sieve residue and 42-mesh sieve residue in accordance with JIS-P-8207 sieve analysis is preferably in the range of from 20 to 50% by weight.

Examples of additives to be used in the present invention include: a sizing agent such as rosin, paraffin wax, a higher fatty acid salt, an alkenylsuccinate, an anhydrous fatty acid, a styrenemaleic anhydride copolymer, an alkylketene dimer, and an epoxidized fatty acid amide; a softening agent such as a reaction product of a maleic anhydride copolymer and a polyalkylenepolyamine, and a quaternary ammonium salt of higher fatty acid; a paper strength increasing agent such as polyacrylamide, starch, polyvinyl alcohol, gelatin, melamine-formaldehyde resin, urea formaldehyde resin, polyethylene imine resin, synthetic rubber latex, polyacrylic ester emulsion, and polyacetic vinyl emulsion; a fixing agent such as aluminum sulfate, aluminum chloride, and polyamide polyamine epichlorohydrine; a filler such as inorganic pigment (e.g., talc, clay, kaolin, calcined kaoline, diatomaceous earth, aluminum hydroxide, titanium oxide, natural silica, synthetic silica, magnesium hydroxide, magnesium carbonate, calcium carbonate, and barium sulfate), and orgainc pigment (e.g., urea-formaldehyde resin, polystyrene resin, polyethylene resin, and acrylic resin); etc. Furthermore, if desired, the pulp composition may further contain a dye, a fluorescent dye, an antistatic agent, and a defoaming agent.

A dispersant such as polyethylene oxide, hydroxyl cellulose, and polyacrylamide may be preferably incorporated in the base paper for the purpose of improving the dispersibility of the paper material.

The paper may be preferably produced by using a shake, controlling a J/W ratio (i.e., ratio of speed of jet(J) of paper material to wire speed(W)) to between 0.9/1 and 1/1, using a dandy roll under wet condition, etc.

In order to further accomplish the effects of the present invention, the base paper is preferably calendered to obtain a density of from 0.9 to 1.1 g/cm$^3$, and particularly preferably from 0.95 to 1.05 g/cm$^3$, and a Bekk smoothness of 200 seconds or more, and particularly preferably 300 seconds or more. In order to prevent the base paper from deteriorating in surface flatness upon coating of a heat-sensitive coating solution, the Cobb-water absorption degree (defined by JIS-P-8140) thereof is 25 g/cm$^3$ or less, and preferably 20 g/m$^2$ or less.

These paper supports may optionally comprise a subbing layer mainly comprising a pigment or a polyethylene coated layer provided thereon, to provide supports for heat-sensitive recording paper.

The heat-sensitive coating solution to be used in the present invention is described below.

In the preparation of the heat-sensitive coating solution, a color former and a color developer each is separately dispersed in each aqueous solution of a watersoluble high molecular compound by means of ball mill or the like. The preparation of the desired particulate color former or color developer can be accomplished, for example, by dispersion with balls of different diameters in an appropriate mixing ratio for an appropriate period of time to obtain the desired particle attributes. Alternatively, a model sand mill (Dynomill ®), or the like may be effectively used.

The dispersion of the color former and the dispersion of the color developer thus prepared are mixed with each other. The admixture is then mixed with an inorganic pigment,a wax, a higher fatty acid amide, a metal soap, and if desired, an ultraviolet absorbent, an antioxidant, a latex series binder, or the like to provide the desired coating solution. These additives may be added to the above-described aqueous dispersion at dispersing the color former or the color developer.

The coating solution thus prepared is normally coated on the support in such a manner that the amount of the color former coated is from 0.2 to 1.0 g/m$^2$, and the amount of the color developer coated is from 0.1 to 2.0 g/m$^2$.

The color former to be used in the present invention is not specifically limited so long as it is for use in commonly used pressure-sensitive recording paper, heat-sensitive recording paper, or the like.

Specific examples of such a color former include triarylmethane series compounds such as 3,3-bis(p-dimethylaminophenyl)-6-dimethylaminophthalide (i.e., Crystal Violet Lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis(p-ethylcarbazol-3-yl)-3-dimethylaminophthalide, and 3,3-bis-(2-phenylindol-yl)-3-yl)-5-dimethylaminophthalide; diphenylmethane series compounds such as 4,4-bis-dimethylaminobenzhydrinbenzyl ether, N-halophenylleucoauramine, and N-2,4,5-trichlorophenylleucoauramine; xanthene series compounds such as Rhodamine B-anilinolactam, 3-diethylamino-7-dibenzylaminofluoran, 3-diethylamino-7 butylaminofluoran, 3-diethylamino-7-(2-chloroanilino)fluoran, 3-diethylamino-6-methyl-7-anilinofluoran, 3-peperidino-6-methyl-7-anilinofluoran, 3-ethyl-tolylamino-6-methyl-7-anilinofluoran, 3-cyclohexyl-methylamino-6-methyl-7-anilinofluoran, 3-diethylamino-6-chloro-7-($\beta$-ethoxyethyl-)aminofluoran, 3-diethylamino-6-chloro-7-(Y-chloropropyl)aminofluoran, 3-diethylamino-6-chloro-7-anilinofluoran, 3-N-cyclohexyl-N-methylamino-6-methyl-7-anilinofluoran, and 3-diethylamino-7-phenylfluoran; thiazine series compounds such as benzoyl leucomethylene blue, and p-nitrobenzoyl leucomethylene blue; and spiro series compounds such as 3-methylspirodinaththopyran, 3-ethylspirodinaphthopyran, 3-benzylspi dinaphthopyran, 3-methylnaphtho-(3-methoxy-benzo)-spiropyran, etc. They can be used singly or as a mixture thereof and are selected according to the intended uses and the desired properties.

As the color developers for use in the present invention, there are preferably used phenol derivatives or aromatic carboxylic acid derivatives, particularly bisphenols. Specific examples of the phenol derivatives include p-octylphenol, p-tert-butylphenol, p-phenylphenol, 2,2-bis(p-hydroxy)propane, 1,1-bis(p-hydroxyphenyl) pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dichlorophenyl)propane.

Specific examples of the aromatic carboxylic acid derivatives include p-hydroxybenzoic acid, propyl p-hydroxybenzoate, butyl p-hydroxybezoate, benzyl p-hydroxybenzoate, 3,5-di-$\alpha$-methylbenzylsalicylic acid, and polyvalent metal salts thereof.

In order to melt and undergo color development reaction at a desired temperature, these color developers may be preferably incorporated in the above-described aqueous solution of a water-soluble polymer or binder in the form of an eutectic mixture with a low melting point heat-fusible material or in the form that a low melting point compound is fused onto the surface of the developer particles.

Specific examples of suitable waxes include paraffin wax, carnauba wax, microcrystalline wax, polyethylene wax, higher fatty acid amides such as stearic acid amide, and ethylene bisstearoamide, and higher fatty acid esters.

Specific examples of suitable metal soaps include polyvalent metal salts of higher fatty acids, such as zinc stearate, aluminum stearate, calcium stearate, and zinc oleate.

Specific examples of suitable inorganic pigments include kaolin, calcined kaolin, talc, agalmatolite, diatomaceous earth, calcium carbonate, aluminum hydroxide, magnesium hydroxide, magnesium carbonate, titanium oxide, and barium carbonate.

These inorganic pigments preferably have an oil absorption of 60 ml/100 g or more and an average particle diameter of 5 μm or less. Such an oil absorbing inorganic pigment may be preferably incorporated in the heatsensitive color forming layer (i.e., recording layer) in a dried amount of from 5 to 50% by weight, and particularly preferably from 10 to 40% by weight.

These additives may be coated on the support in the form of a dispersion in a binder.

As the binder, there is normally used a water-soluble binder. Specific examples of the water-soluble binder include polyvinyl alcohol, hydroxyethyl cellulose, hydroxypropyl cellulose, an ethylene-maleic anhydride copolymer, a styrene-maleic anhydride copolymer, an isobutylene-meleic anhydride copolymer, polyacrylic acid, starch derivatives, casein, and gelatin.

In order to render these binders water-resistant, a water resistance imparting agent (e.g., gelling agent, crosslinking agent) or an emulsion of a hydrophobic polymer such as a styrene-butadiene rubber latex and an acrylic resin emulsion may be incorporated therein.

The binder is incorporated in the heat-sensitive recording layer in a dry weight of from 10 to 30% by weight. Furthermore, if desired, various aids such as a defoaming agent, a fluorescent dye, and a coloring dye may be properly incorporated in the coating solution.

In order to form such a recording layer, the coating of the coating solution on the support can be accomplished by any suitable known method, such as a blade coating method, an air knife coating method, a gravure coating method, a roll coating method, a spray coating method, a dip coating method, a bar coating method, and an extrusion coating method.

The amount of the coating solution to be coated on the support is not specifically limited but is normally in the range of from 3 to 15 g/m$^2$, and preferably from 4 to 10 g/m$^2$, calculated in terms of the dried coverage.

The present heat-sensitive recording paper made of a base paper whose the sum of fluctuations in uneven formation in a wavelength range of from 12.5 to 80 mm as determined by a laser formation measuring apparatus in accordance with the present invention is advantageous in that it is not subject to sticking to the thermal head and that it provides a heat-sensitive recording paper excellent in dot reproduction in half tone recording.

The present invention is further illustrated in the following example, but the present invention is not to be construed as being limited thereto. Unless otherwise indicated, all parts, percents and ratios are by weight.

EXAMPLE

Wood pulps as shown in Table 1 were beaten. Rosin size, anionic polyacrylamide, talc, and aluminum sulfate were then added to these wood pulps in amounts of 1.0 part, 0.5 part, 8.0 parts, and 2.0 parts by weight based on the absolute dry weight of 100 parts of the pulps, respectively. With these added materials, base papers having a basis weight of 64 g/m$^2$ were produced by means of a Fourdrinier paper machine under the conditions as shown in Table 1. (Sample Nos. 1 to 6) A heat-sensitive coating solution prepared in accordance with the process described hereinafter was then coated on these base paper samples in accordance with the coating process described hereinafter to obtain heat-sensitive recording paper samples. These heat-sensitive recording paper samples were then subjected to half tone recording. These heat-sensitive recording paper samples were visually evaluated or dot reproducibility in accordance with the evaluation method described hereinafter.

The properties of these base paper samples and the results of the evaluation of dot reproducibility of these heat-sensitive recording paper samples are shown in Table 2.

Preparation of heat-sensitive coating solution

20 Kg of Crystal Violet Lactone was subjected to dispersion in a 10% aqueous solution of polyvinyl alcohol (saponification degree: 95%; polymerization degree: 500) in a 300-liter ball mill for a 24-hour period. Similarly, 20 kg of 2,2-bis(4-hydroxyphenyl)propane was subjected to dispersion in a 10% aqueous solution of polyvinyl alcohol in a 300-liter ball mill for a 24-hour period. The two dispersions thus prepared were then mixed in a mixing ratio of 1/5 by weight as calculated in terms of the weight of Crystal Violet Lactone and 2,2-bis(4-hydroxyphenyl) propane. Precipitated calcium carbonate was added to the mixture in an amount of 5 kg per 20 kg of the latter. The admixture was sufficiently subjected to dispersion to obtain the desired coating solution.

Coating process

The coating solution thus prepared was coated on one side of the base paper samples by means of an air knife coater in an amount of 6 g/m$^2$. The coated samples were dried in a 50° C. hot air drier, and then machine-calendered.

Evaluation of dot reproducibility

These heat-sensitive recording paper samples were subjected to solid recording at a half tone providing a color density of 0.2 to 0.6 by means of a facsimile transmission having a recording speed of 2 miliseconds per 1 dot, a recording density in primary scanning direction of 5 dots/mm, and a recording density in secondary scanning direction of 6 dots/mm with the pulse width applied by the thermal head varied. These heat-sensitive recording paper samples were then visually evaluated for dot reproducibility.

TABLE 1

| Sample No. | Pulp (parts by weight) | Freeness* | Shake | J/W ratio** | Calender Pressure |
|---|---|---|---|---|---|
| 1 (present invention) | LDP 35 LBKP 65 | 300 cc | Used | 1.03 | 210 Kg/cm |
| 2 (present invention) | LBSP 20 LSKP 80 | 270 cc | Used | 0.96 | 180 Kg/cm |
| 3 (present invention) | LBSP 30 LDP 20 LBKP 50 | 310 cc | Used | 1.00 | 240 Kg/cm |
| 4 (Comparison) | LBKP 50 NBKP 50 | 270 cc | Used | 1.12 | 200 Kg/cm |
| 5 (comparison) | LBKP 100 | 420 cc | Not used | 0.89 | 190 Kg/cm |
| 6 (comparison) | NBSP 20 LBKP 80 | 310 cc | Not used | 1.20 | 150 Kg/cm |

*Freeness is measured in accordance with Canadian Standard Freeness (C.S.F).
**J/W ratio means ratio of speed of jet (J) of paper material to wire speed (W).

TABLE 2

| Sample No. | Properties of base paper: Density ($g/cm^3$) | Bekk Smoothness (sec) | Fluctuation in uneven formation*** (%) | Dot reproducibility of heatsensitive paper |
|---|---|---|---|---|
| 1 (present invention) | 0.96 | 310 | 4.5 | Excellent |
| 2 (present invention) | 1.00 | 285 | 5.8 | Good |
| 3 (present invention) | 1.03 | 348 | 3.9 | Excellent |
| 4 (comparison) | 1.01 | 252 | 11.2 | Poor |
| 5 (comparison) | 0.98 | 263 | 8.9 | Poor |
| 6 (comparison) | 0.86 | 115 | 9.7 | Poor |

***The value is the sum in a wavelength range of 12.5 to 80 mm.

Table 2 shows that the heat-sensitive recording paper samples of the present invention exhibit greatly improved results in dot reproducibility in half tone.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support having thereon a heat sensitive color forming layer, wherein said paper support is made of a base paper which is 7% or less in the sum of fluctuations in uneven formation in a wavelength range of 12.5 to 80 mm as determined by means of a laser formation measuring apparatus.

2. A heat-sensitive recording paper as in claim 1, wherein said support is made of a base paper having a Bekk smoothness of 200 seconds or more.

3. A heat-sensitive recording paper as in claim 2, wherein said support is made of a base paper having a density of from 0.9 to 1.1 $g/cm^3$.

4. A heat-sensitive recording paper as in claim 1, wherein said support is made of a base paper containing as pulp from 10 to 60% by weight of at least one of LBSP and LDP.

5. A heat-sensitive recording paper as in claim 1, wherein the pulp forming said base paper has the freeness according to C.S.F. of 250 to 350 cc.

6. A heat-sensitive recording paper as in claim 5, wherein the length of the beaten pulp fiber is such that the sum of 24-mesh sieve residue and 42-mesh sieve residue in accordance with JIS-P-8207 sieve analysis is in the range of from 20 to 50% by weight.

7. A heat-sensitive recording paper as in claim 1, wherein said support is made of a base paper having a Bekk smmothness of 300 seconds or more.

8. A heat-sensitive recording paper as in claim 7, wherein said support is made of a base paper having a density of from 0.95 to 1.05 $g/cm^3$.

9. A heat-sensitive recording paper as in claim 8, wherein said support is made of a base paper having a Bekk smmothness of 200 seconds or more.

10. A heat-sensitive recording paper as in claim 8, wherein said support is made of a base paper containing as pulp from 10 to 60% by weight of at least one of LBSP and LDP.

11. A heat-sensitive recording paper as in claim 1, which is 5% or less in the sum of fluctuations in uneven formation in a wavelength range of from 12.5 to 80 mm as determined by means of a laser formation measuring apparatus.

12. A heat-sensitive recording paper as in claim 11, wherein said support is made of a base paper having a density of from 0.9 to 1.1 $g/cm^3$.

13. A heat-sensitive recording paper as in claim 11, wherein the pulp forming said base paper has the freeness according to C.S.F. to 250 to 350 cc.

14. A heat-sensitive recording paper as in claim 13, wherein the length of the beaten pulp fiber is such that the sum of 24-mesh sieve residue and 42-mesh sieve residue in accordance with JIS-P-8207 sieve analysis is in the range of from 20 to 50% by weight.

15. A heat-sensitive recording paper as in claim 11, wherein said support is made of a base paper having a Bekk smoothness of 300 seconds or more.

16. A heat-sensitive recording paper as in claim 15, wherein said support is made of a base paper having a density of from 0.95 to 1.05 $g/cm^3$.

* * * * *